US006099264A

United States Patent [19]

Du

[11] Patent Number: 6,099,264

[45] Date of Patent: Aug. 8, 2000

[54] PUMP CONTROLLER

[75] Inventor: Benjamin R. Du, Laguna Beach, Calif.

[73] Assignee: ITT Manufacturing Enterprises, Inc., White Plaines, N.Y.

[21] Appl. No.: 09/140,786

[22] Filed: Aug. 27, 1998

[51] Int. Cl.[7] ..... F04B 49/00

[52] U.S. Cl. ..... 417/300; 417/28; 417/43; 137/494

[58] Field of Search ..... 137/117, 490, 137/494, 114, 495, 483, 101, 119.04, 115; 123/512; 126/362; 222/38, 295, 282, 293, 222; 417/28, 43, 300; 60/477, 468; 74/251; 366/340; 604/9; 57/315

[56] References Cited

U.S. PATENT DOCUMENTS

| | | | |
|---|---|---|---|
| 740,892 | 10/1903 | Meyer . | |
| 1,881,344 | 10/1932 | Apple . | |
| 1,967,746 | 7/1934 | Dulaney | 193/52 |
| 2,332,664 | 10/1943 | Orshansky, Jr. et al. | 193/52 |
| 2,451,933 | 11/1948 | Joppich et al. | 225/26 |
| 2,485,408 | 10/1949 | Pezzillo, Jr. | 103/87 |
| 2,509,570 | 5/1950 | Lee | 222/386.5 |
| 2,535,695 | 12/1950 | Pezillo, Jr. | 103/87 |
| 2,543,686 | 2/1951 | Brown | 121/164 |
| 2,566,436 | 9/1951 | Waite | 225/21 |
| 2,671,462 | 3/1954 | Grier | 137/88 |
| 2,675,946 | 4/1954 | Strempel | 222/137 |
| 2,703,190 | 3/1955 | Muller | 222/36 |
| 2,722,919 | 11/1955 | Kuhn | 121/157 |
| 2,761,078 | 8/1956 | McAdam | 310/67 |
| 2,798,440 | 7/1957 | Hall | 103/152 |
| 2,842,160 | 7/1958 | Rekettye | 137/565 |
| 2,873,684 | 2/1959 | Kaeding | 103/87 |
| 2,880,910 | 4/1959 | Hanson et al. | 222/65 |

(List continued on next page.)

FOREIGN PATENT DOCUMENTS

| | | | |
|---|---|---|---|
| 785597 | 10/1934 | France | 12/3 |
| 1138637 | 10/1962 | Germany . | |
| 144945 | 4/1931 | Switzerland . | |

OTHER PUBLICATIONS

Aro, "Air Operated Diaphragm Pumps"; One page.
Liqui–Box Corporation; "Liqui–Box Press"; Four pages.

*Primary Examiner*—Teresa Walberg
*Assistant Examiner*—Leonid Fastnovsky
*Attorney, Agent, or Firm*—Stetina Brunda Garred & Brucker

[57] ABSTRACT

In accordance with the present invention, there is provided an in-line fluid pump controller for activating and de-activating a fluid pump which is configured to pump fluid through a fluid line. The fluid in the fluid line is characterized by a flow rate and a pressure. The pump controller is provided with a housing which is connectable in fluid communication with the fluid line. The pump controller is further provided with a valve body which is disposed within the housing. The valve body is in fluid flow communication with the fluid of the fluid line and is sized and configured to move in response to the flow rate of the fluid. The valve body has a first position when the flow rate of the fluid is below a threshold flow rate and a second position when the flow rate of the fluid is above the threshold flow rate. The pump controller is further provided with a pivoting lever arm which is rotably connected to the housing. The lever arm is sized and configured to move in response to the pressure of the fluid. The lever arm has a first end portion. The first end portion has a first position when the pressure of the fluid is either below a first threshold pressure or above a second threshold position. The second threshold pressure is greater than the first threshold pressure. The first end portion further has a second position when the pressure of the fluid is above the first threshold pressure and below the second threshold pressure. The pump controller is further provided with a switch which is disposed at the first end portion of the lever arm for de-activating the fluid pump. The switch is triggered in response to the valve body and the first end portion concurrently being in their respective first positions.

16 Claims, 3 Drawing Sheets

U.S. PATENT DOCUMENTS

| | | | |
|---|---|---|---|
| 2,920,575 | 1/1960 | White et al. | 103/87 |
| 2,937,792 | 5/1960 | Firstenberg | 222/144.5 |
| 2,954,146 | 9/1960 | Hullman | 222/193 |
| 2,955,173 | 10/1960 | Kranz | 200/84 |
| 2,981,182 | 4/1961 | Dietricch | 101/366 |
| 2,993,449 | 7/1961 | Harland | 103/87 |
| 3,166,991 | 1/1965 | Blenkle | 92/109 |
| 3,166,993 | 1/1965 | Blenkle | 92/181 |
| 3,167,083 | 1/1965 | Nickell | 137/104 |
| 3,168,967 | 2/1965 | Giampa | 222/129.1 |
| 3,207,070 | 9/1965 | Klinger et al. | 101/366 |
| 3,223,291 | 12/1965 | Thomas | 222/249 |
| 3,268,271 | 8/1966 | Yackle | 303/82 |
| 3,351,238 | 11/1967 | Gilbertson | 222/23 |
| 3,537,616 | 11/1970 | Diebel et al. | 222/66 |
| 3,591,051 | 7/1971 | Mitchell et al. | 222/56 |
| 3,640,433 | 2/1972 | Rodth | 222/129.2 |
| 3,699,846 | 10/1972 | Stomper | 91/346 |
| 3,719,436 | 3/1973 | McFarlin | 417/356 |
| 3,738,775 | 6/1973 | Stickland | 417/38 |
| 3,741,689 | 6/1973 | Rupp | 417/393 |
| 3,749,527 | 7/1973 | Slagle | 417/395 |
| 3,753,629 | 8/1973 | Jackson | 417/388 |
| 3,782,863 | 1/1974 | Rupp | 417/393 |
| 3,787,829 | 1/1974 | Schneier | 340/244 A |
| 3,790,030 | 2/1974 | Ives | 222/135 |
| 3,808,814 | 5/1974 | Macy, II | 60/487 |
| 3,811,792 | 5/1974 | Kennedy, Jr. | 417/28 |
| 3,813,191 | 5/1974 | Foster | 416/406 |
| 3,830,405 | 8/1974 | Jaeger | 222/129.3 |
| 3,957,075 | 5/1976 | Kunz et al. | 137/117 |
| 3,981,414 | 9/1976 | Gust et al. | 222/38 |
| 4,008,984 | 2/1977 | Scholle | 414/393 |
| 4,111,613 | 9/1978 | Martin et al. | 417/420 |
| 4,124,147 | 11/1978 | Priese et al. | 222/135 |
| 4,127,365 | 11/1978 | Martin et al. | 417/420 |
| 4,163,164 | 7/1979 | Pieters | 310/103 |
| 4,165,206 | 8/1979 | Martin et al. | 417/310 |
| 4,172,698 | 10/1979 | Hiaz et al. | 417/393 |
| 4,182,354 | 1/1980 | Bergstedt | 137/10 |
| 4,206,603 | 6/1980 | Mekler | 60/477 |
| 4,247,018 | 1/1981 | Credle | 222/1 |
| 4,273,517 | 6/1981 | Heyl | 417/222 |
| 4,283,645 | 8/1981 | Hoffman | 310/87 |
| 4,296,649 | 10/1981 | Marquart | 74/751 |
| 4,313,714 | 2/1982 | Kubeczka | 417/273 |
| 4,349,130 | 9/1982 | Bair | 222/129.2 |
| 4,398,577 | 8/1983 | Sauer | 141/135 |
| 4,406,382 | 9/1983 | Roth | 222/64 |
| 4,436,493 | 3/1984 | Credle, Jr. | 417/393 |
| 4,446,882 | 5/1984 | Harrison | 137/115 |
| 4,540,349 | 9/1985 | Du | 417/393 |
| 4,551,076 | 11/1985 | DuBois | 417/395 |
| 4,619,378 | 10/1986 | de Man | 222/144.5 |
| 4,645,095 | 2/1987 | Coppola | 222/64 |
| 4,681,518 | 7/1987 | Credle, Jr. | 417/395 |
| 4,690,310 | 9/1987 | Rasmussen | 222/309 |
| 4,714,413 | 12/1987 | Duffy | 417/293 |
| 4,736,873 | 3/1988 | Patriquin | 222/249 |
| 4,738,597 | 4/1988 | D'Agostino et al. | 417/282 |
| 4,741,675 | 5/1988 | Bowden | 417/295 |
| 4,745,904 | 5/1988 | Cagle | 123/512 |
| 4,753,370 | 6/1988 | Rudick | 222/105 |
| 4,757,839 | 7/1988 | Marchal | 137/490 |
| 4,790,458 | 12/1988 | Moore | 222/386 |
| 4,793,524 | 12/1988 | Starr | 222/309 |
| 4,815,634 | 3/1989 | Nowicki | 222/133 |
| 4,828,465 | 5/1989 | Credle, Jr. | 417/395 |
| 4,854,721 | 8/1989 | Hume | 366/340 |
| 4,887,632 | 12/1989 | Tanaka et al. | 137/117 |
| 4,898,518 | 2/1990 | Hubbard et al. | 416/360 |
| 4,905,724 | 3/1990 | Ranalletta et al. | 137/114 |
| 4,923,168 | 5/1990 | Murata et al. | 251/75 |
| 4,930,555 | 6/1990 | Rudick | 141/98 |
| 4,934,566 | 6/1990 | Guerette | 222/38 |
| 4,936,289 | 6/1990 | Peterson | 126/362 |
| 4,957,220 | 9/1990 | Du | 222/66 |
| 4,967,936 | 11/1990 | Bingler | 222/129.2 |
| 5,002,469 | 3/1991 | Murata et al. | 417/403 |
| 5,056,686 | 10/1991 | Jarrett | 222/129.2 |
| 5,083,906 | 1/1992 | Du | 417/395 |
| 5,158,210 | 10/1992 | Du | 222/134 |
| 5,170,912 | 12/1992 | Du | 222/129.2 |
| 5,188,255 | 2/1993 | Du | 222/1 |
| 5,199,854 | 4/1993 | Aoyama | 417/282 |
| 5,230,443 | 7/1993 | Du | 222/123 |
| 5,336,166 | 8/1994 | Sierra | 604/9 |
| 5,350,083 | 9/1994 | Du | 222/134 |
| 5,361,843 | 11/1994 | Du | 222/134 |
| 5,412,948 | 5/1995 | Komura et al. | 60/468 |
| 5,435,466 | 7/1995 | Du | 222/108 |
| 5,470,209 | 11/1995 | Hartley et al. | 417/401 |
| 5,664,940 | 9/1997 | Du | 417/393 |
| 5,873,230 | 2/1999 | Wussmann et al. | 57/315 |
| 5,957,149 | 9/1999 | Karg | 137/119.04 |
| 5,996,616 | 12/1999 | Hormann | 137/494 |

Fig. 1
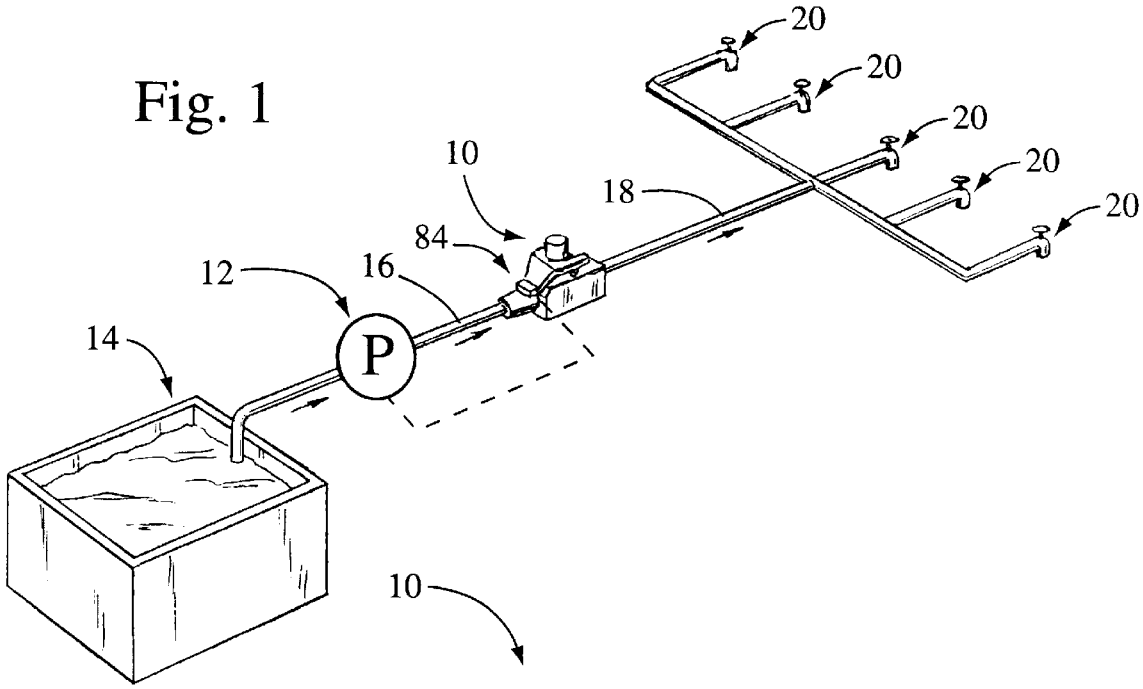
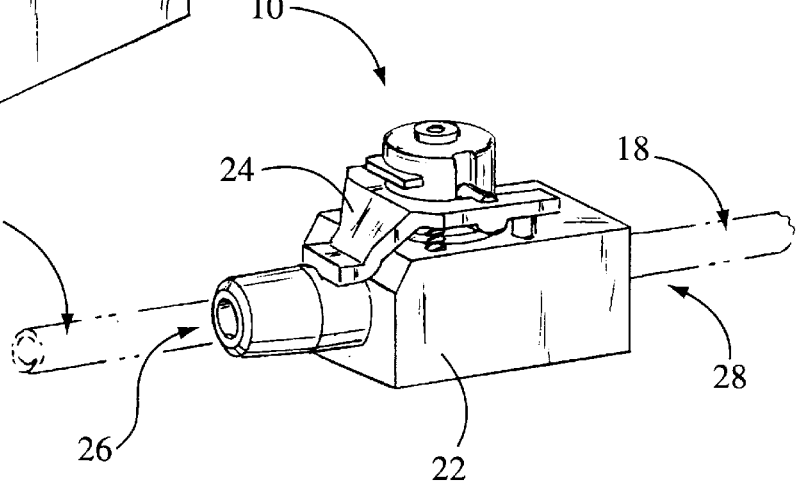
Fig. 2

Fig. 4
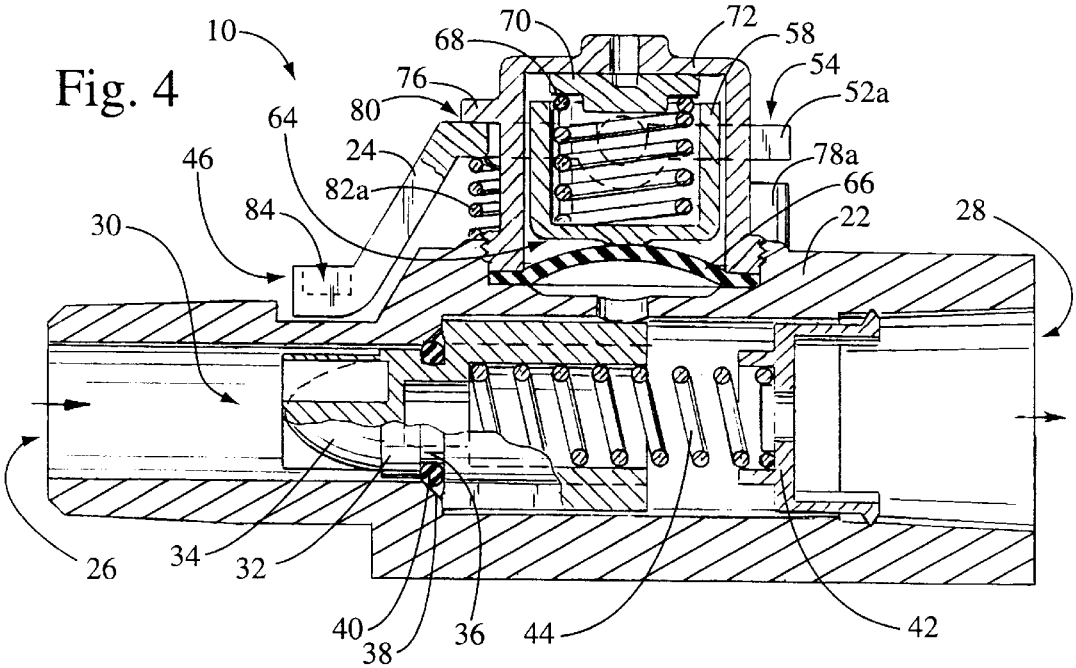
Fig. 5
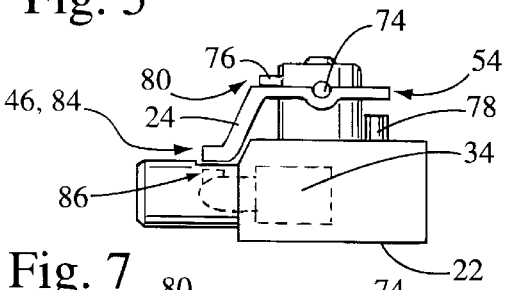
Fig. 6
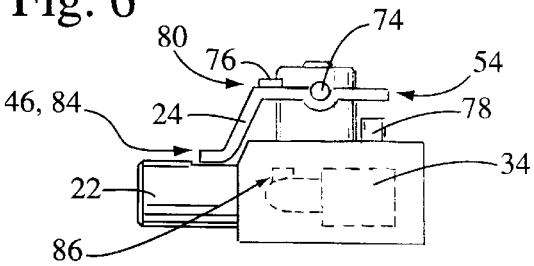
Fig. 7
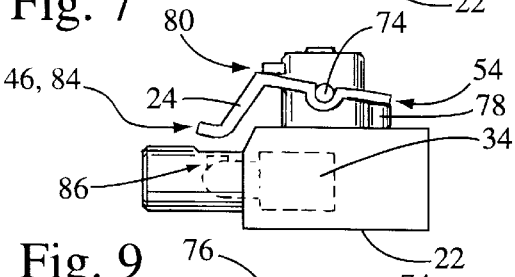
Fig. 8
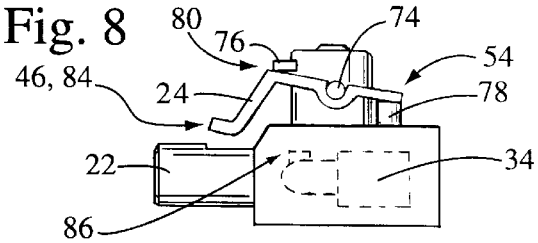
Fig. 9
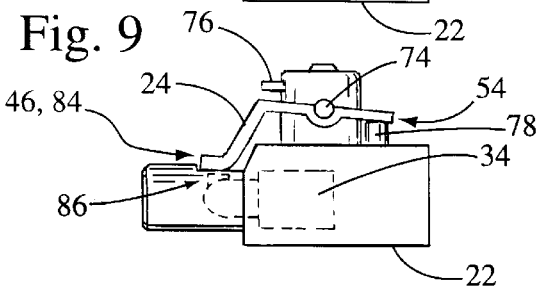
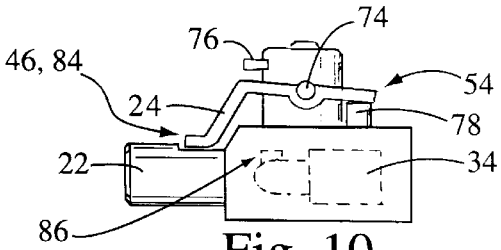
Fig. 10

PUMP CONTROLLER

FIELD OF THE INVENTION

The present invention relates generally to fluid pump controllers, and more particularly to an in-line fluid pump controller which is responsive to fluid flow and pressure.

BACKGROUND OF THE INVENTION

Pumps for moving fluids are well known in the art. Such pumps may be of an in-line nature such that the pump pumps fluids through it. There are a variety of devices which are used to control the activation and de-activation of such pumps. As one of ordinary skill in the art can appreciate, the continued running of a fluid pump when there is no fluid to pump, i.e., running the pump dry, can be harmful to the life of the pump. In addition, the continued running of a fluid pump when there is a substantial downstream restriction is also harmful to the life of a pump. This is the case where a pump to attached to line which terminates at a closed faucet, for example. As such, it is desirable to have a pump controller device which can de-activate the running of a pump when the fluid circuit enters either one of these undesirable conditions. In addition, it is recognized that some prior art controller devices unnecessarily cycle the pump into on and off conditions. Such unnecessary on/off cycling is undesirable are this too is harmful to the life of the pump. There is known in the art pump controller devices which have attempted to guard some of these conditions. These prior art pump controller devices, however, are typically complex and may include a variety of electronic senors and actuators. Such complexity often impacts the manufacturing and maintenance costs, reliability and relative ease of use.

It is therefore evident that there exists a need in the art for a pump controller facilitates de-activation of a pump under multiple conditions and which is relatively simple in construction and use.

SUMMARY OF THE INVENTION

In accordance with the present invention, there is provided an in-line fluid pump controller for activating and de-activating a fluid pump which is configured to pump fluid through a fluid line. The fluid in the fluid line is characterized by a flow rate and a pressure. The pump controller is provided with a housing which is connectable in fluid communication with the fluid line. The pump controller is further provided with a valve body which is disposed within the housing. The valve body is in fluid flow communication with the fluid of the fluid line and is sized and configured to move in response to the flow rate of the fluid. The valve body has a first position when the flow rate of the fluid is below a threshold flow rate and a second position when the flow rate of the fluid is above the threshold flow rate. The pump controller is further provided with a pivoting lever arm which is rotably connected to the housing. The lever arm is sized and configured to move in response to the pressure of the fluid. The lever arm has a first end portion. The first end portion has a first position when the pressure of the fluid is either below a first threshold pressure or above a second threshold pressure. The second threshold pressure is greater than the first threshold pressure. The first end portion further has a second position when the pressure of the fluid is above the first threshold pressure and below the second threshold pressure. The pump controller is further provided with a switch which is disposed at the first end portion of the lever arm for de-activating the fluid pump.

Importantly, the switch is triggered in response to the valve body and the first end portion concurrently being in their respective first positions. Preferably, the switch is a Hall Effect switch. In this regard, a magnet is disposed within the valve body for triggering the switch when the valve body is in the first position.

The pump controller is particularly adapted to shut-off an up-line fluid pump under certain particular situations because the pump controller is responsive to both fluid flow rate and pressure. Specifically, the pump controller, via the switch, signals the fluid pump to turn-off when there is a no-flow condition due to either 1) a lack of source fluid to be pumped, or 2) the downstream fluid line being closed or substantially restricted. In this regard, the threshold flow rate may be selected to correspond to a substantially no-flow condition. It is recognized that when there is a lack of source fluid to be pumped, the pump and therefore the pump controller runs dry. As a result, the fluid pressure in the pump controller disappears. The first threshold pressure of the fluid may be selected to correspond to such a practically no fluid pressure condition. It is further recognized that when the downstream fluid line is closed or substantially restricted, the fluid pressure in the fluid line increases. This is due to the fluid pump continuing to pump and simply nowhere for the fluid to flow. As such, the second threshold pressure may be selected to correspond to such a closed or substantially restricted downstream fluid line condition.

In the preferred embodiment of the present invention, the pump controller is provided with a piston which is movable in response to the pressure of the fluid. The piston is ratably attached to the lever arm at a primary pivot point. The piston has a first position when the pressure of the fluid is below the first threshold pressure. The piston further has a second position when the pressure of the fluid is above the first threshold pressure and below the second threshold pressure. The piston further has a third position when the pressure of the fluid is above the second threshold pressure.

The housing may be provided with a first stopper which engages the lever arm between the first end portion and the primary pivot point at a secondary pivot point when the pressure of the fluid is above the first threshold pressure. Movement of the piston rotates the lever arm about the secondary pivot point when the first stopper is engaged with the lever arm. The lever arm may be provided with a second end portion with the primary pivot point being disposed between the first and second end portions. The housing may be further provided with a second stopper which engages the lever arm at the second end portion when the pressure of the fluid is below the first threshold pressure. Movement of the piston rotates the lever arm about the second end portion when the second stopper is engaged with the lever arm. The various moving members, i.e., the piston and lever arm, are provided with biasing springs which bias such members into selected ones of their respective positions.

As such, based on the foregoing, the present invention mitigates the inefficiencies and limitations associated with prior art in-line fluid pump control devices. Advantageously, the pump controller of the present invention is a relatively simple device. The pump controller does not rely upon any electronic sensor to be connected to the fluid supply source or to the pump to detect that the fluid supply source has run dry. Rather, such a condition is sensed by the pump controller by the lack of fluid flow rate and lack of pressure within it. Similarly, the pump controller does not rely upon any electronic sensor to be connect to the downstream fluid lines to detect a restricted flow condition. Again, such a condition is sensed by the pump controller by the lack of fluid flow rate and high pressure within it. As such, the pump controller does not rely upon any electronic sensors at the fluid source, pump or downstream fluid conduits and the associated complexity and costs.

As discussed above, the pump controller may be provided with biasing springs and stoppers which configure the various moving members so as to facilitate ease of selecting those particular fluid flow rate and pressure combinations which trigger the pump to be deactivated. In this regard, adjustments to the system are relatively simple to perform. Additionally, the pump controller may be provided with a Hall Effect switch which utilizes a magnet disposed within the valve body. As one of ordinary skill in the art can appreciate, such a design mitigates the risk of electrically shorting the switch and the connecting to the pump.

Accordingly, the present invention represents a significant advance in the art.

BRIEF DESCRIPTION OF THE DRAWINGS

These, as well as other features of the present invention, will become more apparent upon reference to the drawings wherein:

FIG. 1 is a perspective view of the pump controller of the present invention shown in conjunction with a symbolically depicted pump, fluid source and downstream fluid conduits;

FIG. 2 is a perspective view of the pump controller of the present invention;

FIG. 4 is a cross-sectional view of the pump controller of FIG. 2; and

FIGS. 5–10 are symbolic side views of the pump controller of the present invention as shown with the valve body and lever arm of their respective operable positions.

DETAILED DESCRIPTION OF THE PREFERRED EMBODIMENT

Figure 3:
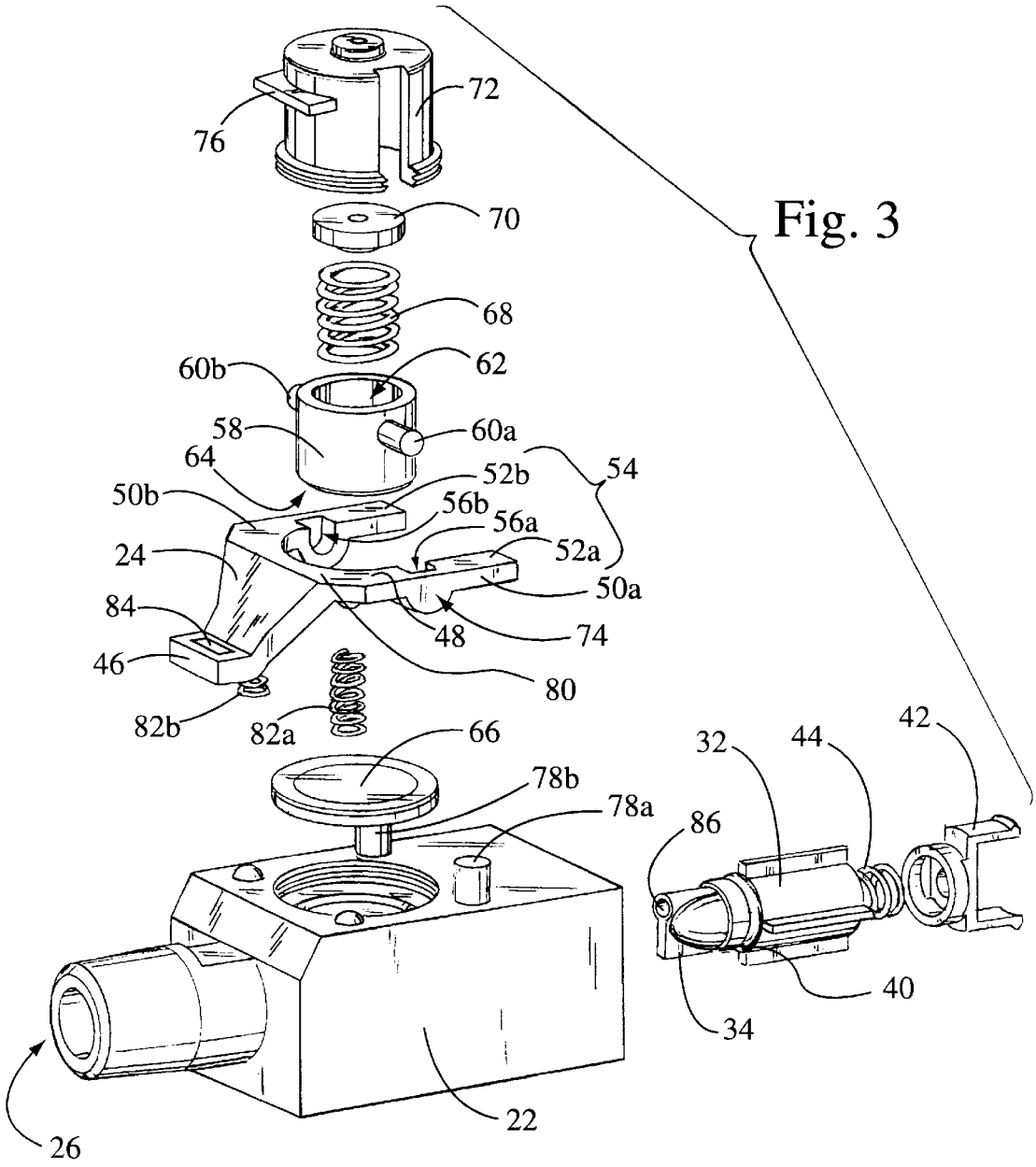
FIG. 3 is an exploded view of the pump controller of FIG. 2.

Referring now to the drawings wherein the showings are for purposes of illustrating a preferred embodiment of the present invention only, and not for purposes of limiting the same, FIGS. 1–10 illustrate a fluid pump controller 10 which is constructed in accordance with the present invention.

In accordance with the present invention, there is provided an in-line fluid pump controller 10 for activating and de-activating a fluid pump 12 which is configured to pump fluid. Referring now to FIG. 1, there is symbolically depicted an exemplary configuration wherein the fluid pump 12 draws fluid from a fluid source 14 and pumps the fluid through a fluid line 16. The fluid line 16 is attachable to the pump controller 10 which in turn is attachable to a downstream fluid line 18. The downstream fluid line 18 may terminate at any number of discharge ports 20 which may take the form of a faucet, nozzle, or other fluid conduit devices. As such, the pump controller 10 is contemplated to be an in-line device with the fluid from the upstream fluid line 16 passing through the pump controller 10 and into the downstream fluid line 18. Importantly, the fluid which passes into and through the pump controller 10 is characterized by a flow rate and a pressure. As discussed in much greater detail below, the pump controller 10 is provided with a switch 84. Symbolically depicted is the switch 84 in electrical communication with the pump 12 for facilitating control thereof.

Referring now to FIG. 2, the pump controller 10 is depicted in its operable assemblage, and in FIG. 3, the pump controller 10 is depicted in an exploded view. In addition, FIG. 4 depicts a cross-sectional view of the pump controller 10. The pump controller 10 is provided with a housing 22. The housing 22 has an inlet port 26 for connection with the upstream fluid line 16. The housing further has an outlet port 28 for connection with the downstream fluid line 18.

The pump controller 10 has a interior cavity 30 through which the fluid passes. A movable valve body 32 is disposed within the interior cavity 30. The valve body 32 is disposed in fluid flow communication with any fluid which passes within the interior cavity 30. The valve body 32 has a frontal portion 34. The valve body 32 is sized and configured such that fluid which passes into the interior cavity 30 impinges upon the frontal portion 34 thereof. The frontal portion 34 may be provided with a outer rim 36 and the interior cavity 30 may be provided with a annular shoulder portion 38 which is sized and configured to sealably engage the outer rim 36 of the valve body 32. In this respect, the outer rim 36 is configured to seat within the annular shoulder portion 38 of the interior cavity 30 for facilitating a valving action of the fluid thereat. An O-ring 40 may be fitted annularly about the outer rim 38 to facilitate sealed engagement of the shoulder portion thereat.

Importantly, the valve body 32 is sized and configured to move in response to the flow rate of the fluid. In this respect, impingement of fluid upon the frontal portion 34 of the valve body 32 provides the motive force to move the valve body 32 (from left to right as shown in FIG. 4). As one of ordinary skill in the art can appreciate, as the flow rate of the fluid which impinges upon and flows over the frontal portion 34 is increased, there is a corresponding increase in the force which is applied to the frontal portion 34.

In the preferred embodiment of the present invention, the valve body 32 is provided with a support base 42 which is fixed within interior cavity 30. The support base 42 is sized and configured such that it does not substantially interfere with fluid flow through the interior cavity 30. Interposed between the support base 42 and the valve body 32 is a valve body biasing spring 44. The valve body biasing spring 44 biases the valve body 32 into a closed position. A threshold flow through the pump controller 10 overcomes the spring force of the valve body biasing spring 44 and moves the valve body 32 into an open position. Such a threshold flow rate may be set at 0.1 GPM, for example. Thus, the relative position of the valve body 32 within the interior cavity 30 is flow dependant. In this respect, the valve body 32 has a first position when the flow rate of the fluid is below a threshold flow rate and a second position when the flow rate of the fluid is above the threshold flow rate.

The pump controller 10 is further provided with a pivoting lever arm 24 which is connected to the housing 22 in rotable communication therewith. The lever arm 24 is sized and configured to move in response to the pressure of the fluid. The lever arm 24 has a first end portion 46. Stemming from the first end portion 46 is a yoke 48 which has a pair of legs 50*a*, 50*b*. The legs 50*a*, 50*b* each respectively have leg ends 52*a*, 52*b*. The leg ends 52*a*, 52*b* cooperatively form a second end portion 54 of the lever arm 24. As discussed below, the legs 50*a*, 50*b* are further respectively provided with notches 56*a*, 56*b*.

In the preferred embodiment of the present invention, the pump controller 10 is provided with a piston 58 which is movable in response to the pressure of the fluid. The piston 58 is rotably attached to the lever arm 24 at a primary pivot point 74. In this regard, the piston 58 is provided with pivot pins 60*a*, 60*b*. The pivot pins 60*a*, 60*b* are cooperatively sized and configured to be respectively received by the notches 56*a*, 56*b* of the lever arm legs 50*a*, 50*b*. As such, the piston 58 is positioned between the lever arm legs 50*a*, 50*b*.

The piston 58 has an interior portion 62 which is sized and configured to receive a piston biasing spring 68 therewithin. A piston cap 70 is attached to one end of the piston biasing spring 68. The housing 22 has a piston cover 72. The piston cover 72 may be threadily affixed to the housing 22. The piston cap 70 is interposed between the piston biasing spring 68 and the piston cover 72. As such, as best shown in FIG. 4, upward movement of the piston 58 causes compression of the piston biasing spring 68. The piston 58 is further provided with a lower outer surface 64 and the pump controller 10 is further provided with a diaphragm 66. The diaphragm 66 is disposed adjacent to the interior cavity 30 and is therefore able to be in fluid communication with fluids within the interior cavity 30. The diaphragm 66 is sized and configured to flex in response to fluid pressure changes within the interior cavity 30. The diaphragm 66 is additionally in contact with the lower outer surface 64 of the piston 58 such that flexure of the diaphragm 66 provides the motive force to move the piston 58. Thus, as mentioned above, the piston 58 moves in response to the pressure of the fluid, because the diaphragm 66 which it contacts moves in response to the fluid pressure.

The piston 58 is supported by the lever arm 24 via the pivot pins 60*a*, 60*b* being respectively received by the notches 56*a*, 56*b*. As such, the lever arm 24 is adapted to rotate about a primary pivot point 74 which is collocated with an axis through the pivot pins 60*a*, 60*b*. Thus, the lever arm 24 is able to rotate about the primary pivot point 74 with the first and second end portions 46, 54 moving in opposing directions.

The diaphragm 66 and the piston biasing spring 68 are cooperatively sized and configured such that the piston 58 has first, second and third positions which respectively correspond to increased flexure of the diaphragm 66 resulting from increased fluid pressure. The piston 58 assumes its first position when the pressure of the fluid is below a first threshold pressure. The piston assumes its second position when the pressure of the fluid is above the first threshold pressure and below a second threshold pressure. The piston further assumes a third position when the pressure of the fluid is above the second threshold pressure. Thus, when the piston 58 moves from its first position to its second and third positions, the piston biasing spring 68 is compressed. It is noted that primary pivot point 74 has first, second and third positions which respectively correspond to those of the piston 58 because the primary pivot point 74 is defined by the position of the piston 58. In this regard, referring to FIGS. 9 and 10, the primary pivot point 74 and therefore the piston 58 (although not depicted) are in their respective first positions. Similarly, referring to FIGS. 7 and 8, the primary pivot point 74 and therefore the piston 58 (although not depicted) are in their respective second positions. And finally, referring to FIGS. 4–6, the primary pivot point 74 and therefore the piston 58 (only depicted in FIG. 4) are in their respective third positions.

The first end portion 46 of the lever arm 24 is sized and configured to have a first position when the pressure of the fluid below the first threshold pressure, as depicted in FIGS. 9 and 10. In addition, the first end portion 46 assumes its first position when the fluid pressure is above the second threshold pressure, as depicted in FIGS. 4–6. The first end portion 46 further has a second position when the pressure of the fluid is above the first threshold pressure and below the second threshold pressure, as depicted in FIGS. 7 and 8.

In order to facilitate the first end portion 46 to assume its first and second positions, in the preferred embodiment of the present invention, the housing 22 is provided with a first stopper 76 which engages the lever arm 24 between the first end portion 46 and the primary pivot point at a secondary pivot point 80 when the pressure of the fluid is above the first threshold pressure. Such engagement is depicted in FIGS. 4–8. Movement of the piston 58 rotates the lever arm 24 about the secondary pivot point 80 when the first stopper 76 is engaged with the lever arm 24. The housing 22 may be further provided with second stoppers 78*a*, 78*b* which are sized and configured to engage the lever arm 24 at the second end portion 54 when the pressure of the fluid is below the first threshold pressure. In particular, the stoppers 78*a*, 78*b* respectively engage the lever arm 24 at the leg ends 52*a*, 52*b*. Movement of the piston 58 rotates the lever arm 24 about the second end portion 54 when the second stoppers 78*a*, 78*b* are engaged with the lever arm 24.

In addition, the pump controller 10 may be provided with secondary biasing springs 82*a*, 82*b* which is interposed between the housing 22 and the lever arm 24 for urging the lever arm 24 to rotate about the primary pivot point 74. Thus, the secondary biasing springs 82*a*, 82*b* are used to bias the lever arm 24 into engagement with the first stopper 76 to establish the secondary pivot point 80 thereat.

As mentioned above, the pump controller 10 is provided with a switch 84 for de-activating the fluid pump 12. The switch 84 is disposed at the first end portion 46 of the lever arm 24. Importantly, the switch 84 is triggered in response to the valve body 32 and the first end portion 46 concurrently being in their respective first positions. Preferably, the switch is a Hall Effect switch. In this regard, a magnet 86 may be disposed within the valve body 32 for triggering the switch 84 when the valve body 32 is in the first position.

The pump controller 10 of the present invention is particularly adapted to shut-off an up-line fluid pump 12 under certain particular situations because the pump controller 10 is responsive to both fluid flow rate and pressure. Specifically, the pump controller 10, via the switch, signals the fluid pump 12 to turn-off when there is a no-flow condition due to either 1) a lack of source fluid to be pumped, or 2) the downstream fluid line 18 being closed or substantially restricted. In this regard, the threshold flow rate may be selected to correspond to a substantially no-flow condition. It is recognized that when there is a lack of source fluid to be pumped, the pump 12 and therefore the pump controller 10 runs dry. As a result, the fluid pressure in the pump controller 10 disappears. The first threshold pressure of the fluid may be selected to correspond to such a practically no fluid pressure condition. It is further recognized that when the downstream fluid line 18 is closed or substantially restricted, the fluid pressure within the in-line fluid controller 10 increases. This is due to the fluid pump 12 continuing to pump and simply nowhere for the fluid to flow. As such, the second threshold pressure may be selected to correspond to such a closed or substantially restricted downstream fluid line condition.

The piston biasing spring 68 is sensitive between low and medium back pressure conditions. The primary pivot point 74 moves between the first and second positions. The piston 58 is fully biased in its first position when there is a relatively low back pressure condition which correspond to those pressures which are below the first threshold pressure. It is only when there is at least a medium back pressure (i.e., pressures above the first threshold pressure) does the piston 58 change and the piston biasing spring 68 is overcome, thereby moving the piston 58 into its second position. The piston biasing spring 68 is preferably stiffer than the secondary biasing springs 82*a*, 82*b* with the the piston biasing spring 68 overcome under high back pressure conditions, whereas the secondary biasing springs 82*a*, 82*b* being overcome under medium back pressure conditions).

Advantageously, when there is a restricted flow condition, the position of the piston 58 and therefore the primary pivot point 74 guards against the pump 12 being undesirably turned off. A restricted flow condition contemplates a medium back pressure. Such turn-off guarding is due to the sensitivity of the piston biasing spring 68. As such, the positioning of the primary pivot point 74 mitigates an on/off cycling of the pump as the flow fluctuates between medium and low flow conditions and therefore between medium and low back pressure conditions.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. An in-line fluid pump controller for activating and de-activating a fluid pump which is configured to pump fluid through a fluid line, the fluid having a flow rate and a pressure, the pump controller comprising:

a housing connectable in fluid communication with the fluid line;

a valve body disposed within the housing, being in fluid flow communication with the fluid of the fluid line, being sized and configured to move in response to the flow rate of the fluid, the valve body having a first position when the flow rate of the fluid is below a threshold flow rate and a second position when the flow rate of the fluid is above the threshold flow rate;

a pivoting lever arm rotably connected to the housing, the lever arm being sized and configured to move in response to the pressure of the fluid, the lever arm having a first end portion, the first end portion having a first position when the pressure of the fluid is either below a first threshold pressure or above a second threshold position, the second threshold pressure being greater than the first threshold pressure, the first end portion further having a second position when the pressure of the fluid is above the first threshold pressure and below the second threshold pressure; and a switch disposed at the first end portion of the lever arm for de-activating the fluid pump, the switch being triggered in response to the valve body and the first end portion concurrently being in their respective first positions.

2. The pump controller of claim 1 wherein the switch is a Hall Effect switch.

3. The pump controller of claim 2 wherein the valve body further comprises a magnet disposed therein, the magnet being sized and configured to have sufficient magnetic properties so as to trigger the switch.

4. The pump controller of claim 1 wherein the lever arm having a movable primary pivot point, the primary pivot point being movable in response to the pressure of the fluid, the primary pivot point having a first position when the pressure of the fluid is below the first threshold pressure, the primary pivot point having a second position when the pressure of the fluid is above the first threshold pressure and below the second threshold pressure, the primary pivot point having a third position when the pressure of the fluid is above the second threshold pressure.

5. The pump controller of claim 1 further having a piston, the piston being movable in response to the pressure of the fluid, the piston being rotably attached to the lever arm at a primary pivot point.

6. The pump controller of claim 5 wherein the piston having a first position when the pressure of the fluid is below the first threshold pressure, the piston having a second position when the pressure of the fluid is above the first threshold pressure and below the second threshold pressure, the piston having a third position when the pressure of the fluid is above the second threshold pressure.

7. The pump controller of claim 5 wherein the housing having a first stopper sized and configured to engage the lever arm between the first end portion and the primary pivot point at a secondary pivot point when the pressure of the fluid is above the first threshold pressure, movement of the piston rotates the lever arm about the secondary pivot point when the first stopper is engaged with the lever arm.

8. The pump controller of claim 5 wherein the housing having a first stopper sized and configured to engage the lever arm between the first end portion and the primary pivot point at a secondary pivot point when the piston is in a respective one of its second and third positions, movement of the piston rotates the lever arm about the secondary pivot point when the first stopper is engaged with the lever arm.

9. The pump controller of claim 5 wherein the lever arm having a second end portion, the primary pivot point being disposed between the first and second end portions, the housing having a second stopper sized and configured to engage the lever arm at the second end portion when the pressure of the fluid is below the first threshold pressure, movement of the piston rotates the lever arm about the second end portion when the second stopper is engaged with the lever arm.

10. The pump controller of claim 5 wherein the lever arm having a second end portion, the primary pivot point being disposed between the first and second end portions, the housing having a second stopper sized and configured to engage the lever arm at the second end portion when the piston is in a respective one of its first and second positions, movement of the piston rotates the lever arm about the second end portion when the second stopper is engaged with the lever arm.

11. The pump controller of claim 5 further having a diaphragm, the diaphragm being in fluid communication with the fluid of the fluid line, the diaphragm being movable in response to the pressure of the fluid, the diaphragm being disposed adjacent the piston for moving the piston in response to movement of the diaphragm.

12. The pump controller of claim 5 wherein the piston having a biasing spring, the biasing spring being attached to the housing and the piston so as to bias the position of the piston relative to the housing.

13. The pump controller of claim 12 wherein the biasing spring being sized and configured to bias the piston in its first position.

14. The pump controller of claim 1 wherein the valve body having a biasing spring, the biasing spring being attached to the housing and the valve body so as to bias the position of the piston relative to the housing.

15. The pump controller of claim 14 wherein the biasing spring being sized and configured to bias the valve body in its first position.

16. The pump controller of claim 1 wherein the housing having an annular shoulder portion for allowing the fluid of the fluid line to pass therethrough, the shoulder portion being formed to receive the valve body in seated engagement therewith when the valve body is in its first position for restricting fluid flow therebetween.

* * * * *